US011078613B2

(12) United States Patent
Bae et al.

(10) Patent No.: US 11,078,613 B2
(45) Date of Patent: Aug. 3, 2021

(54) LAUNDRY HANDLING APPARATUS AND CONTROL METHOD THEREFOR

(71) Applicant: LG ELECTRONICS INC., Seoul (KR)

(72) Inventors: Sungcheol Bae, Seoul (KR); Jinseong Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 116 days.

(21) Appl. No.: 16/073,232

(22) PCT Filed: Jan. 26, 2017

(86) PCT No.: PCT/KR2017/000985
§ 371 (c)(1),
(2) Date: Jul. 26, 2018

(87) PCT Pub. No.: WO2017/131484
PCT Pub. Date: Aug. 3, 2017

(65) Prior Publication Data

US 2019/0032264 A1 Jan. 31, 2019

(30) Foreign Application Priority Data

Jan. 27, 2016 (KR) ..... 10-2016-0010014

(51) Int. Cl.
*D06F 33/44* (2020.01)
*D06F 33/00* (2020.01)
(Continued)

(52) U.S. Cl.
CPC ..... *D06F 33/44* (2020.02); *D06F 29/00* (2013.01); *D06F 33/00* (2013.01); *D06F 33/70* (2020.02);
(Continued)

(58) Field of Classification Search
CPC ..... D06F 25/00; D06F 29/00; D06F 29/005; D06F 2202/12; D06F 2204/10;
(Continued)

(56) References Cited

U.S. PATENT DOCUMENTS 4,335,591 A * 6/1982 Gillespie ..... D06F 33/00 68/12.23
7,621,012 B2 * 11/2009 Kim ..... D06F 33/00 8/147
(Continued)

FOREIGN PATENT DOCUMENTS

JP 2014-094074 5/2014
KR 10-2004-0096147 11/2004
(Continued)

OTHER PUBLICATIONS

International Search Report (with English Translation) and Written Opinion dated May 30, 2017 issued in Application No. PCT/KR2017/000985.

*Primary Examiner* — Joseph L. Perrin
(74) *Attorney, Agent, or Firm* — Ked & Associates, LLP

(57) ABSTRACT

The present invention relates to a laundry handling apparatus and a control method therefor, the laundry handling apparatus being provided with multiple laundry units performing laundry independently of each other. If a first laundry unit and a second laundry unit simultaneously perform laundry and if laundry is not collected after any one laundry unit has completed laundering, the laundry handling apparatus operates with added laundry time according to the laundry time of the other laundry unit, thereby preventing the laundry from creasing and being damaged, and changes the laundry time such that the first and second laundry units finish laundering at the same time, thereby having the effect of facilitating laundry collection.

12 Claims, 8 Drawing Sheets

(51) Int. Cl.

| | |
|---|---|
| ***D06F 33/70*** | (2020.01) |
| ***D06F 58/46*** | (2020.01) |
| ***D06F 29/00*** | (2006.01) |
| ***D06F 31/00*** | (2006.01) |
| ***D06F 101/14*** | (2020.01) |
| ***D06F 103/38*** | (2020.01) |
| ***D06F 105/56*** | (2020.01) |
| ***D06F 39/00*** | (2020.01) |
| ***D06F 37/40*** | (2006.01) |
| ***D06F 37/04*** | (2006.01) |
| ***D06F 37/22*** | (2006.01) |
| *D06F 25/00* | (2006.01) |
| *D06F 35/00* | (2006.01) |

(52) U.S. Cl.
CPC ..... *D06F 37/04* (2013.01); *D06F 37/22* (2013.01); *D06F 37/40* (2013.01); *D06F 39/00* (2013.01); *D06F 58/46* (2020.02); *D06F 25/00* (2013.01); *D06F 29/005* (2013.01); *D06F 31/00* (2013.01); *D06F 35/006* (2013.01); *D06F 35/007* (2013.01); *D06F 39/006* (2013.01); *D06F 2101/14* (2020.02); *D06F 2103/38* (2020.02); *D06F 2105/56* (2020.02); *D06F 2202/12* (2013.01); *D06F 2204/10* (2013.01); *D06F 2212/02* (2013.01); *D06F 2220/00* (2013.01); *D06F 2226/00* (2013.01)

(58) Field of Classification Search
CPC ..... D06F 2212/02; D06F 2220/00; D06F 2102/14; D06F 2103/38; D06F 2105/56; D06F 31/00; D06F 33/00; D06F 37/04; D06F 37/22; D06F 37/40; D06F 39/00; D06F 39/006; D06F 33/44; D06F 33/70; D06F 58/46
See application file for complete search history.

(56) References Cited

U.S. PATENT DOCUMENTS

| | | | | |
|---|---|---|---|---|
| 2007/0151300 | A1* | 7/2007 | Sunshine | D06F 29/005 68/3 R |
| 2008/0022465 | A1 | 1/2008 | Jun et al. | |
| 2010/0269266 | A1 | 10/2010 | Lee et al. | |
| 2011/0016640 | A1* | 1/2011 | Kim | D06F 33/00 8/137 |
| 2011/0048079 | A1* | 3/2011 | Kim | D06F 37/42 68/13 R |
| 2011/0185511 | A1* | 8/2011 | Ryoo | D06F 29/00 8/137 |
| 2012/0047661 | A1 | 3/2012 | Hong et al. | |
| 2017/0335500 | A1* | 11/2017 | Li | D06F 29/005 |
| 2017/0342626 | A1* | 11/2017 | Li | D06F 39/04 |

FOREIGN PATENT DOCUMENTS

| | | |
|---|---|---|
| KR | 10-2008-0010047 | 1/2008 |
| KR | 10-2010-0118227 | 11/2010 |
| KR | 10-2010-0120055 | 11/2010 |

* cited by examiner

LAUNDRY HANDLING APPARATUS AND CONTROL METHOD THEREFOR

CROSS-REFERENCE TO RELATED PATENT APPLICATIONS

This application is a U.S. National Stage Application under 35 U.S.C. § 371 of PCT Application No. PCT/KR2017/000985, filed Jan. 26, 2017, which claims priority to Korean Patent Application No. 10-2016-0010014, filed Jan. 27, 2016, whose entire disclosures are hereby incorporated by reference.

TECHNICAL FIELD

The present invention relates to a laundry handling apparatus having a plurality of laundry units, and more particularly, to a laundry handling apparatus for enabling a plurality of laundry units to finish an operation simultaneously, and a control method therefor.

BACKGROUND ART

Generally, a laundry handling apparatus is an apparatus that processes laundry through various operations such as laundering, spin-dry and/or drying.

The laundry handling apparatus is an apparatus that supplies water to immerse the laundry, and dissolves an appropriate amount of the detergent in the wash water to remove the impurities from the laundry.

Such a laundry handling apparatus includes a laundry handling apparatus that washes laundry such as clothing or bedding by using the emulsifying action of the detergent, the water current action caused by the rotation of the tub or the laundry blade, and a mechanical force applied by the laundry blade, a dryer that applies a hot air or a cold air to dry the laundry, and a refresher that removes the crease of the clothes by applying steam. In addition, a washer-drier provides a combination of various functions.

A general laundry handling apparatus should be supplied with a minimum amount of wash water for performing laundering. In the case where a tub having a large capacity is provided, there is a problem in that a large amount of wash water is required even when laundering a small amount of laundry.

In response to this demand, a mini laundry handling apparatus for laundering a small amount of laundry or a laundry handling apparatus for babies has been appeared. Further, there is a tendency to develop a laundry handling apparatus having a plurality of laundry units having different capacities.

The laundry handling apparatus outputs an alarm after completion of laundering to allow the user to recognize the completion of laundering. However, in some cases, the user can not hear the alarm and the laundry cannot be collected, or although the user heard the alarm, the user cannot collect the laundry immediately and the collection of the laundry may be delayed.

Regardless of the type and shape of the laundry, when the laundry is not collected and stored in the tub for a long time, crease occurs in the laundry, and unpleasant odors are generated in the case of the laundry which is not dried.

DISCLOSURE

Technical Problem

It is an object of the present invention to provide a laundry handling apparatus and a control method thereof, and to provide a laundry handling apparatus capable of simultaneously finishing an operation, when a plurality of laundry units simultaneously operate in the laundry handling apparatus having a plurality of laundry units performing laundering independently of each other, and a control method thereof.

Technical Solution

In an aspect, there is provided a laundry handling apparatus including: a first laundry unit having a first tub; and a second laundry unit that has a second tub and which operates independently of the first laundry unit; a first controller for controlling the first laundry unit; and a second controller for controlling the second laundry unit, wherein, when the second laundry unit starts to operate simultaneously with the first laundry unit, the first controller compares a first laundry time of the first laundry unit with a second laundry time of the second laundry unit, and sets a simultaneous finish if a time difference is equal to or less than a set time such that the first laundry unit and the second laundry unit finish laundering simultaneously.

The first controller increases or decreases a time of at least one of a laundering process, a rinsing process, a spin-dry process, and a drying process of the first laundry unit such that the first laundry unit and the second laundry unit finish laundering simultaneously.

The first controller accelerates or decelerates a spin-dry speed with respect to the spin-dry process of the first laundry unit, and varies the number of operating heaters and a temperature of the heater with respect to the drying process of the first laundry unit such that the first laundry unit and the second laundry unit finish laundering simultaneously.

The first controller increases the first laundry time by allowing the first laundry unit to add and perform at least one of a soaking process, a crease resistant process, and a cooling process, or shortens a time for the soaking process, the crease resistant process, and the cooling process included in the first laundry time such that the first laundry unit and the second laundry unit finish laundering simultaneously.

The first controller adds a waiting time between a laundering process, a rinsing process, a spin-dry process, and a drying process of the first laundry unit such that the first laundry unit and the second laundry unit finish laundering simultaneously.

The first controller delays any one operation so that at least one of water supply, spin-dry, drying operations, and an operation according to wash water heating of the first laundry unit is not performed simultaneously with at least one of water supply, spin-dry, drying operations, and an operation according to wash water heating of the second laundry unit such that the first laundry unit and the second laundry unit finish laundering simultaneously.

The first controller compares the first laundry time with the second laundry time to calculate one of a time difference between start times and a time difference between finish times to compare with the set time, and allows the first laundry unit to operate according to a preset operation without changing the laundry time if the time difference exceeds the set time.

The first controller cancels the simultaneous finish and allows to operate individually according to a preset operation, when an error occurs from any one of the first laundry unit and the second laundry unit after setting the simultaneous finish.

The laundry handling apparatus further includes an output unit for displaying an operation state of the first laundry unit, wherein the first controller outputs a guide message for the simultaneous finish through a change of the first laundry time through the output unit, when the simultaneous finish is set.

The laundry handling apparatus further includes an input unit having a progress key and a cancel key, wherein the first controller sets a simultaneous finish when the progress key is inputted in response to the guide message or when the cancel key is not inputted within a certain time, and cancels the simultaneous finish when the cancel key is inputted.

The laundry handling apparatus further includes an input unit having a simultaneous finish key, wherein, when the simultaneous finish key is inputted, even if the time difference exceeds the set time, the first controller changes the first laundry time such that the first laundry unit and the second laundry unit finish laundering simultaneously.

The second laundry unit and the first laundry unit are disposed vertically.

In another aspect, there is provided a method for controlling a laundry handling apparatus comprising a first laundry unit having a first tub, and a second laundry unit that has a second tub and which operates independently of the first laundry unit, the method including: comparing a first laundry time of the first laundry unit with a second laundry time of the second laundry unit, when the first laundry unit starts to operate simultaneously with the second laundry unit; setting a simultaneous finish by changing the first laundry time when a time difference is equal to or less than a set time; operating the first laundry unit and the second laundry unit; and finishing the first laundry unit and the second laundry unit simultaneously.

The method further includes individually operating the first laundry unit according to a preset operation without changing the laundry time, when the time difference exceeds the set time.

The method further includes canceling the simultaneous finish, when an error occurs from any one of the first laundry unit and the second laundry unit after the simultaneous finish is set; and individually operating the first laundry unit and the second laundry unit according to a preset operation.

Setting a simultaneous finish includes the steps of: displaying a guide message for the simultaneous finish through changing the first laundry time; setting the simultaneous finish when a progress key is inputted in response to the guide message or when a cancel key is not inputted within a certain time; and canceling the simultaneous finish when the cancel key is inputted.

The method further includes inputting a simultaneous finish key that is provided; and changing the first laundry time to set the simultaneous finish even if the time difference exceeds the set time, when the simultaneous finish key is inputted.

Setting a simultaneous finish includes setting a simultaneous finish by increasing or decreasing a time of at least one of a laundering process, a rinsing process, a spin-dry process, and a drying process of the first laundry unit.

Setting a simultaneous finish includes accelerating or decelerating a spin-dry speed for the spin-dry process of the first laundry unit, and varying a number of operating heaters and a temperature of the heater with respect to the drying process of the first laundry unit such that the first laundry unit and the second laundry unit finish laundering simultaneously.

Setting a simultaneous finish includes adding at least one of a soaking process, a crease resistant process, and a cooling process to the first laundry unit or decreasing a time thereof, adding a waiting time between a laundering process, a rinsing process, a spin-dry process, and a drying process of the first laundry unit, or changing a time so that at least one of water supply, spin-dry, drying operations, and an operation according to wash water heating of the first laundry unit is not performed simultaneously with the second laundry unit.

Advantageous Effects

According to the laundry handling apparatus configured as described above and the control method of the present invention, when a plurality of laundry units operating independently of each other simultaneously perform the laundering process, even if the finish time of any one laundry unit is different, the plurality of laundry units are set to finish laundering simultaneously, so that the laundry can be easily collected and the convenience of the user is improved and the damage of the laundry is minimized. In addition, when changing the laundry time for simultaneous finish, the water supply, the spin-dry, and the drying are not performed simultaneously, thereby preventing damage to the laundry handling apparatus and preventing an instantaneous increase in power consumption.

MODE FOR INVENTION

Hereinafter, preferred embodiments of the present invention will be described with standard to the accompanying drawings. In describing the present embodiment, the same designations and the same standard numerals are used for the same components, and further description thereof will be omitted.

Figure 1:
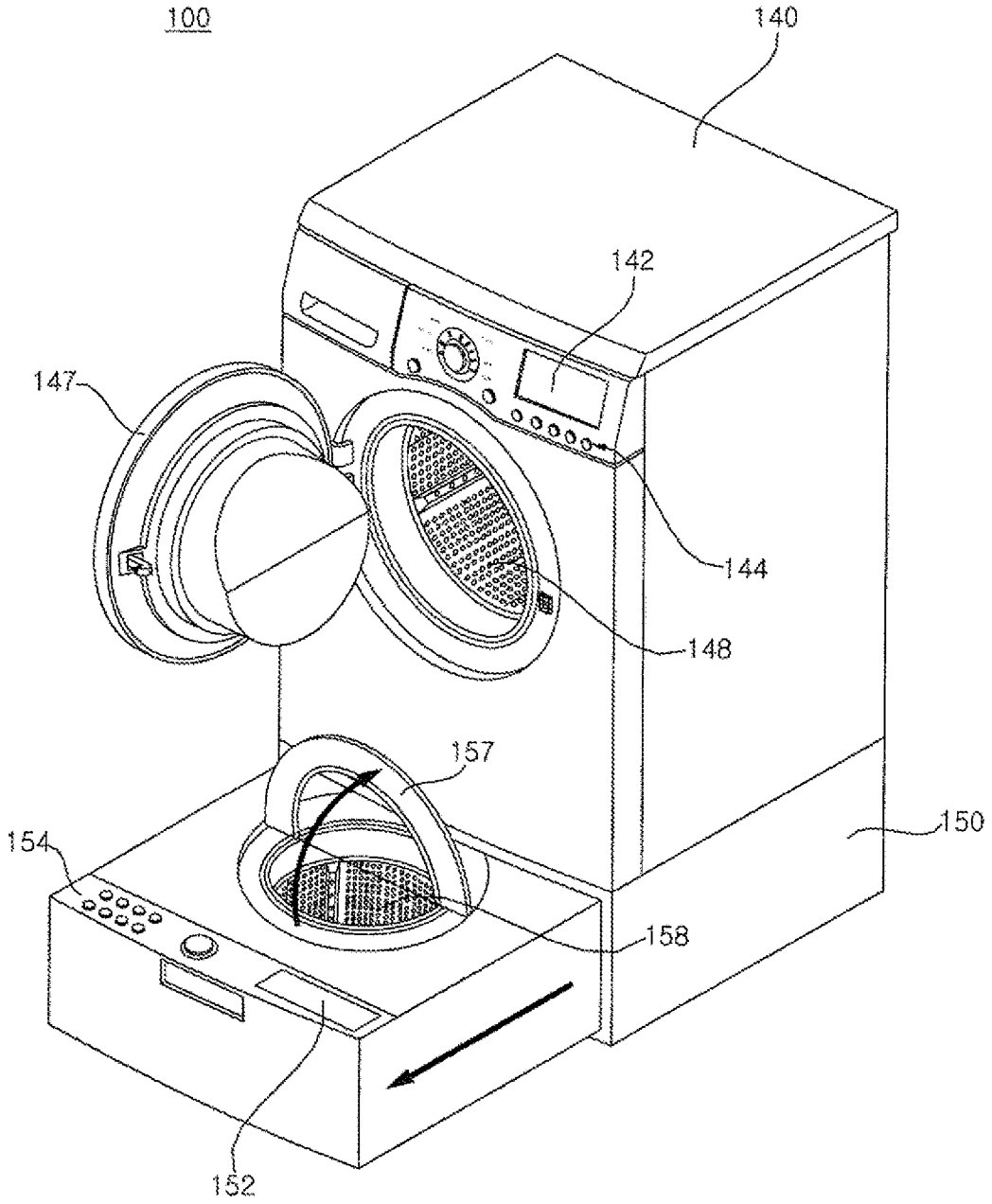
FIG. 1 is a perspective view illustrating a laundry handling apparatus according to an embodiment of the present invention.

FIG. 1 is a perspective view illustrating a laundry handling apparatus according to an embodiment of the present invention.

Referring to FIG. 1, a laundry handling apparatus 100 includes a first laundry unit 140 and a second laundry unit 150.

The first laundry unit 140 and the second laundry unit 150 are disposed vertically. The first laundry unit 140 is disposed above the second laundry unit 150, and the first laundry unit 140 and the second laundry unit 150 can be coupled to and separated from each other.

The first laundry unit 140 is in the form of a front load laundry handling apparatus, and the second laundry unit 150 is in the form of a top load laundry handling apparatus.

The second laundry unit 150 has a structure in which it is slidably opened and closed in the front and rear direction like a drawer. When the second laundry unit 150 is pulled to the front, the upper end of the second laundry unit 150 is exposed. A second input unit 154, a second output unit 152, and a second door 157 are disposed in the upper end of the second laundry unit 150.

The first laundry unit 140 may include a first input unit 144, a first output unit 142 and a first door 147. The second laundry unit 150 may include the second input unit 154, the second output unit 152, and the second door 157.

The first laundry unit 140 and the second laundry unit 150 are provided with separate input units 144 and 154 and output units 142 and 152, so that a command can be input independently of each other and an operation corresponding to the inputted command can be performed.

The first laundry unit 140 and the second laundry unit 150 may respectively include a water storage tank for containing water, a tub 148, 158 which accommodates laundry and is rotatably installed in the water storage tank, a motor for rotating the tub, a water supply device for supplying water into the water storage tank or the tub, and a draining device for draining water in the water storage tank, and perform laundering independently of each other.

It is shown in the drawing that the capacity of the tub of the first laundry unit 140 is larger than the capacity of the tub of the second laundry unit 150. However, the capacity of the tub of the first laundry unit 140 may be equal to or smaller than the capacity of the tub of the second laundry unit 150. The tub capacity of each of the laundry units 140 and 150 is not limited.

The first laundry unit 140 and the second laundry unit 150 may be a washer-drier for simultaneously providing a laundering function and a drying function.

Figure 2:
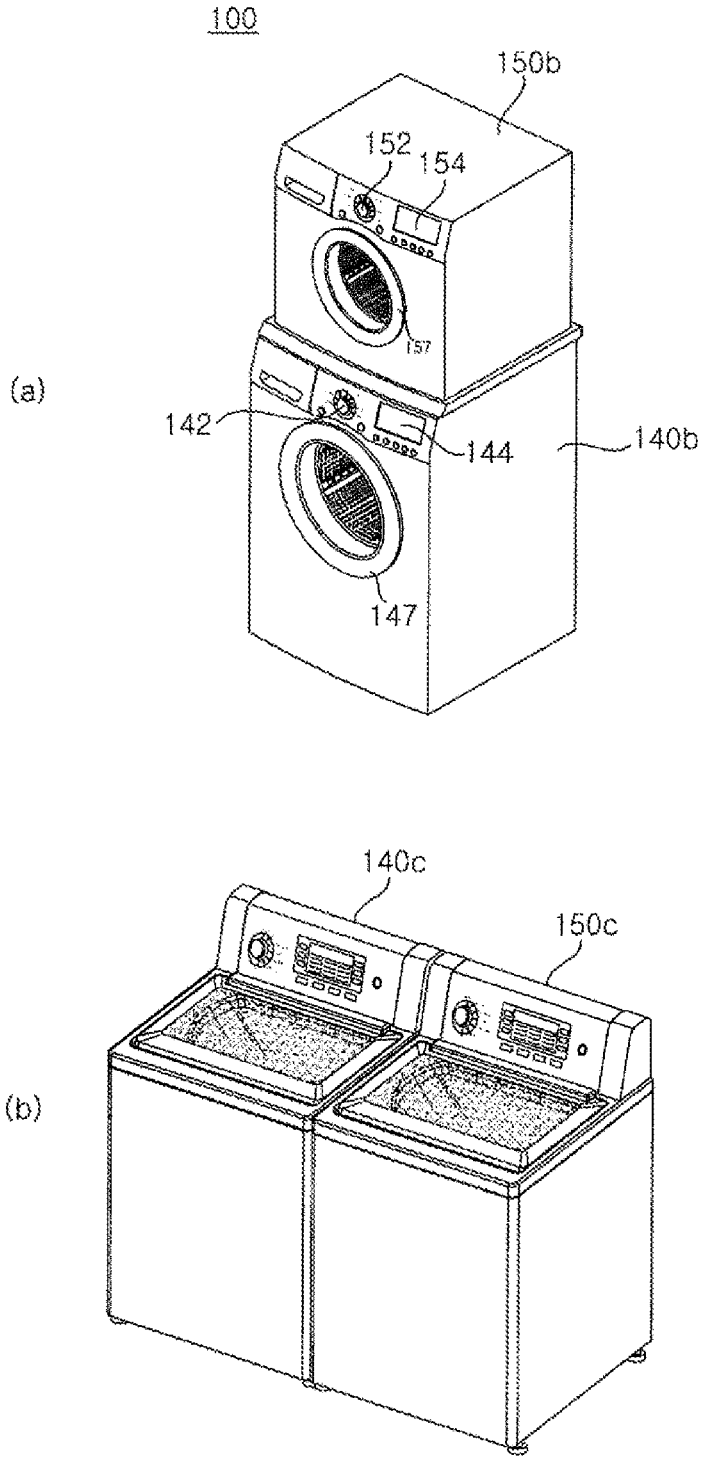
FIG. 2 is a perspective view illustrating a shape of a laundry handling apparatus according to another embodiment of the present invention.

FIG. 2 is a perspective view illustrating a shape of a laundry handling apparatus according to another embodiment of the present invention.

As shown in FIG. 2A, in the laundry handling apparatus, both the first laundry unit 140*b* and the second laundry unit 150*b* may be in the form of a front load laundry handling apparatus.

In addition, in the laundry handling apparatus, the second laundry unit 150*b* may be disposed above the first laundry unit 140*a*.

As shown in FIG. 2B, in the laundry handling apparatus, both the first laundry unit 140*c* and the second laundry unit 150*c* may be in the form of a top load laundry handling apparatus.

In addition, in the laundry handling apparatus, the first laundry unit 140 and the second laundry unit 150 may not be disposed vertically, but may be disposed laterally.

Hereinafter, the laundry handling apparatus will be illustrated that, as shown in FIG. 1, the first laundry unit 140 and the second laundry unit 150 are vertically disposed, but the disposition and form are not limited.

Figure 3:
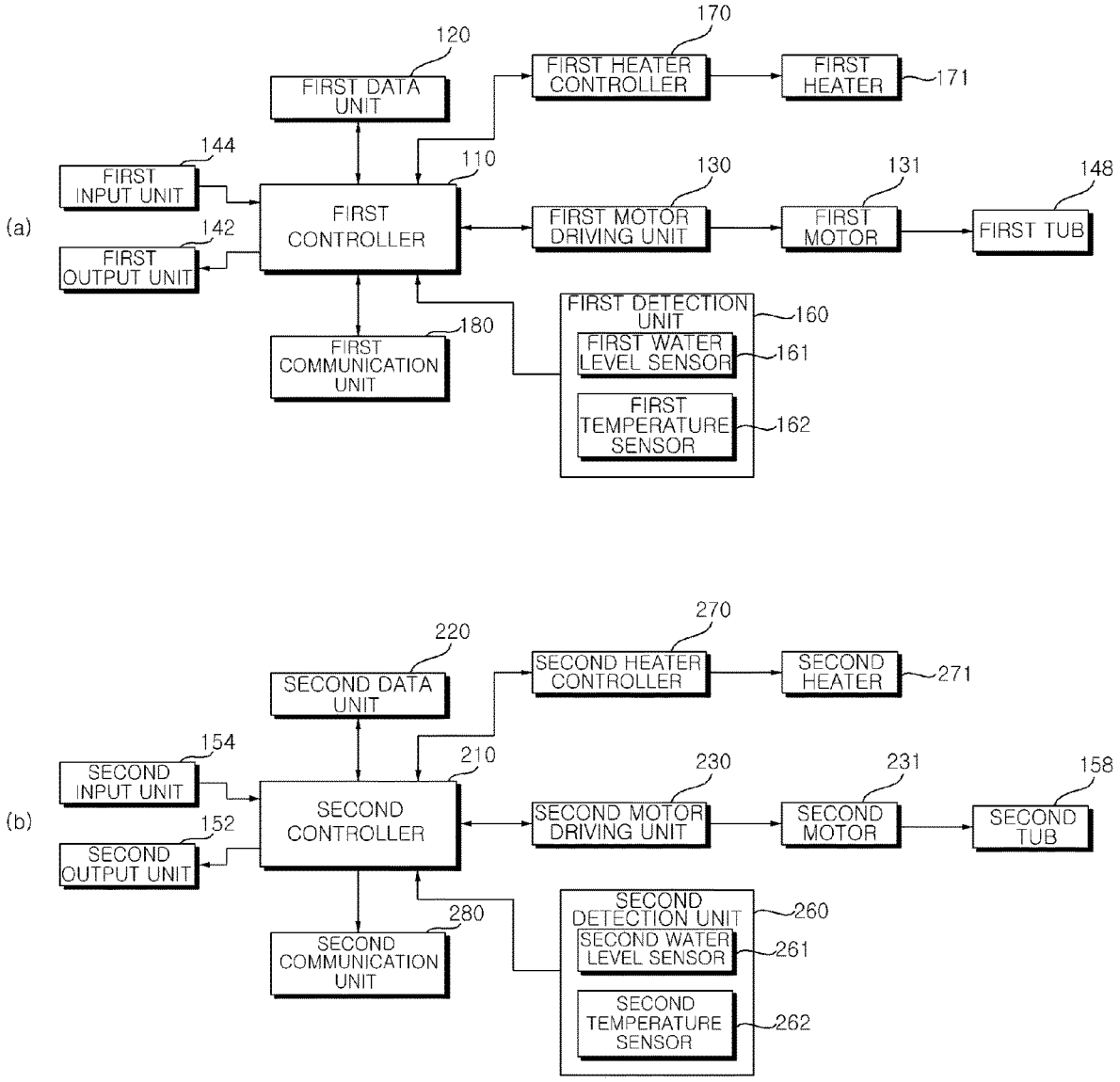
FIG. 3 is a block diagram illustrating a configuration of a first laundry unit and a second laundry unit of a laundry handling apparatus according to an embodiment of the present invention.

FIG. 3 is a block diagram illustrating a configuration of a first laundry unit and a second laundry unit of a laundry handling apparatus according to an embodiment of the present invention.

As shown in FIG. 3A, the first laundry unit 140 includes a first input unit 144, a first output unit 142, a first tub 148, a first motor 131, a first motor driving unit 130, a first detection unit 160, a first heater controller 170, a first heater 171, a first communication unit 180, a first data unit 120, and a first controller 110 for controlling the overall operation of the first laundry unit 140.

As shown in FIG. 3B, the second laundry unit 150 includes a second input unit 154, a second output unit 152, a second tub 158, a second motor 231, a second motor driving unit 230, a second detection unit 260, a second heater controller 270, a second heater 271, a second communication unit 280, a second data unit 220, and a second controller 210 for controlling the overall operation of the second laundry unit 150. At this time, the configuration of the second laundry unit 150 is identically applied to the configuration of the first laundry unit 140 described below in the operation of performing laundering, and a description thereof will be omitted.

The first input unit 144 includes input means such as at least one button, a switch, and a touch pad, and inputs laundry setting such as a power input, a laundering course, a water level, a temperature, and the like. The first input unit 144 includes a progress key, a cancel key, and a simultaneous finish key.

The first input unit 144 outputs a signal for the progress of operation or the setting cancel corresponding to the input of a progress key or a cancel key to the first controller 110 in response to a guide message outputted through the first output unit 142. In addition, when the simultaneous finish key is inputted, the first input unit 144 inputs a signal to the first controller 110 so that the first laundry unit finishes laundering simultaneously with the second laundry unit. Even if a separate progress key, cancel key, or simultaneous finish key is not provided, when at least two of a plurality of provided buttons are operated simultaneously or at least two buttons are operated in a specific order, the first input unit 144 inputs a signal for progress, cancel, and simultaneous finish to the first controller 110 respectively.

The first output unit 142 includes a display unit for displaying information on the laundry setting inputted by the first input unit 144 and outputting an operation state of the first laundry unit, and includes a speaker, a buzzer, and the like for outputting a certain sound effect or a warning sound. The display unit displays the laundry setting and the operation state of the first laundry unit on a screen in a combination of at least one of a character, an image, an icon, and a special character, and displays a notification according to the operation state.

The first data unit 120 stores control data for controlling the operation of the laundry handling apparatus, laundry setting data inputted, laundry time data calculated in accordance with the laundry setting, data about the laundering course, and data for determining whether an error has occurred in the laundry handling apparatus. In addition, the first data unit 120 stores data detected or measured through the first detection unit 160 during operation of the laundry handling apparatus and data transmitted and received through the first communication unit 180. Particularly, the laundry time data received from the second communication unit can be stored in the first data unit 120.

The first communication unit 180 is connected to the second laundry unit 150 in a wired or wireless manner to transmit and receive data. When laundering starts in response to a control command of the first controller 110, when unusual occurs during laundering, when the laundering is finished, the first communication unit 180 transmits/receives data on the laundry setting or operation state, or laundry time data to/from the second communication unit 280 of the second laundry unit.

The first detection unit 160 includes a plurality of sensors to measure a voltage or a current of the laundry handling apparatus, and measures data such as temperature and water pressure and inputs the measured data to the first controller 110. At this time, the first detection unit 160 includes a first water level sensor 161 and a first temperature sensor 162. The first water level sensor 161 is installed in the first tub 148, and detects the water level of the wash water to input the water level data to the first controller 110. The first temperature sensor 162 measures the temperature of the wash water. A plurality of first temperature sensors 162 are installed in different positions, and detect the temperature of the heater to input the detected temperature to the first controller 110, when the first heater 171 for the temperature inside a control circuit, for heating or drying the wash water operates, in addition to the temperature of the wash water.

The first motor driving unit 130 supplies operating power to the first motor 131 connected to the first tub to rotate according to the control command of the first control unit 110. The first motor driving unit 130 controls the rotation direction, the rotation angle, and the rotation speed of the first motor 131 according to the setting. The first motor driving unit 130 controls the first motor 131 to operate differently according to the set laundering course, and the progressing laundering, rinsing, and spin-dry.

At this time, the first motor driving unit 130 differently controls the rotation direction, the rotation angle, and the rotation speed of the first motor to form the water current of a specific type of the wash water in the first tub 148.

The first heater controller 170 controls the operation power supplied to the first heater 171 in response to the control command of the first controller 110 so that the first heater 171 can be operated or stopped. The first heater controller 170 controls the operation of the first heater by changing the number of the operating first heaters or varying the temperature of the first heater.

At least one first heater 171 may be provided to heat the wash water or generate heat during the drying operation. In the drying operation, the heater 171 generates heat, and the generated heat is circulated in the first tub 148 by a drying fan (not shown) to dry the laundry.

The first controller 110 controls a series of laundering processes of laundering, rinsing, spin-dry, and drying.

The first controller 110 enables to perform water supply and drainage to the first tub 148 according to the operation setting inputted from the first input unit 144, and applies a control command to the first motor driving unit 130, so that the first tub 148 rotates according to the operation of the motor 131 to perform laundering. In addition, the first controller 110 applies a control command to the heater controller 170 to operate the first heater 171 so that the wash water is heated or the drying operation is performed.

The first controller 110 stores the inputted operation setting in the first data unit 120, and outputs the operation setting or operation state through the first output unit 142. In addition, the first controller 110 transmits data to the second laundry unit 150 through the first communication unit 180, and receives data of the second laundry unit 150.

The first controller 110 transmits data of the first laundry unit operation to the second laundry unit through the first communication unit 180 during the first laundry unit operation, and receives data of the second laundry unit during the second laundry unit operation to check the operation of the second laundry unit.

Accordingly, the first controller 110 determines whether the first and second laundry units 140 and 150 are operated simultaneously, and sets the simultaneous finish so that the first and second washing units finish the laundering simultaneously in response to the inputted time of the laundry setting.

When the laundry setting of the first laundry unit is inputted and the laundry setting of the second laundry unit is inputted within a certain time, the first controller 110 receives the laundry setting data of the second laundry unit to determine the simultaneous operation, and sets the simultaneous finish. In addition, when the laundry setting is inputted to the second laundry unit after the first laundry unit starts to operate, the first controller 110 sets the first laundry unit and the second laundry unit to finish simultaneously or operate individually in response to an elapsed time after the first laundry unit starts to operate.

In addition, the first controller 110 may compare a first finish time at which the laundering of the first laundry unit is finished with a second finish time of the second laundry unit, and set a simultaneous finish according to the time difference.

When the simultaneous finish key is inputted through the first input unit, the first controller 110 may set the first and second laundry units to finish simultaneously regardless of the laundry setting input time of the second laundry unit.

The first controller 110 changes at least one of the laundry time of the first laundry unit and the laundry time of the second laundry unit and sets the first and second laundry units to finish simultaneously, and enables to perform the additional operation at the changed time.

When the laundry time is changed and the simultaneous finish is set, the first controller 110 outputs a guide message for the simultaneous finish through the first output unit 142, and enables to operate according to the changed laundry time or to cancel the simultaneous finish, in response to the input of the progress key or cancel key of the first input unit 144.

The first controller 110 may display a notification indicating that simultaneous finish is set through the first output unit 142, when the simultaneous finish is set.

As shown in FIG. 3B, the second controller 210 of the second laundry unit 150 can also set the simultaneous finish by adding or changing the laundry time of the second laundry unit in response to the laundry time data of the first laundry unit 140 as described above.

The second controller 210 outputs data on the laundry setting and operation state through the second output unit 152. When the laundry time of the second laundry unit is changed, the second controller 210 outputs a guide message of changing the laundry time through the second output unit 152, and can progress the simultaneous finish in response to the second input unit 154, or cancel the setting.

When any one laundry time is changed, the first controller 110 and the second controller 210 can correspondingly increase or decrease the time of at least one of laundering, rinsing, spin-dry, and drying. Further, the first controller 110 and the second controller 210 can set the first laundry unit and the second laundry unit to finish simultaneously.

For example, the first controller 110 or the second controller 210 changes the laundry time in such a manner that the spin-dry speed is accelerated or decreased with respect to the spin-dry process among the laundering, rinsing, spin-dry, and drying so that the first and second laundry units finish operation simultaneously. In addition, the first controller 110 or the second controller 210 changes the laundry time in such a manner that the number of the operating heaters and the temperature of the heater are varied during the drying process so that the first and second laundry units finish operation simultaneously.

The first controller 110 and the second controller 210 adds and performs at least one of a soaking process, a crease resistant process, and a cooling process to increase the laundry time, or shortens the time for the pre-set soaking process, crease resistant process, and cooling process so that the first laundry unit and the second laundry unit finish operation simultaneously.

In addition, the first controller 110 and the second controller 210 change the laundry time by adding a waiting time or delaying any one preset process so that the first laundry unit and the second laundry unit finish operation simultaneously. In particular, the first controller 110 and the second controller 210 can change the laundry time by delaying the operation of any one laundry unit so that water supply, spin-dry, drying operation, and operation according to the heating of wash water are not performed simultaneously as the first laundry unit and the second laundry unit operate simultaneously.

Meanwhile, the first controller 110 and the second controller 210 enables the first and second laundry units to operate individually if simultaneous finish is not set even when the first and second laundry units operate simultaneously.

When the cancel key is inputted through the input unit 144, 154 after the simultaneous finish is set, the first controller 110 and the second controller 210 cancel the simultaneous finish when an error occurs in any one washing unit, and enable the first and second washing units to operate individually according to respective laundry settings.

Figure 4:
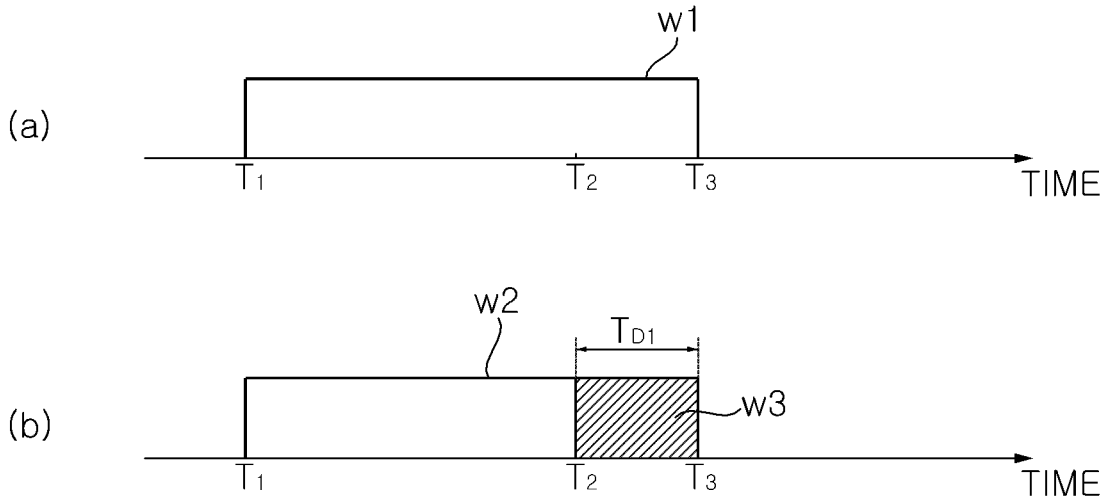
FIG. 4 is an exemplary diagram for explaining the change of laundry time according to the simultaneous finish when beginning the simultaneous start, in a laundry handling apparatus according to an embodiment of the present invention.

FIG. 4 is an exemplary diagram for explaining the change of laundry time according to the simultaneous finish when beginning the simultaneous start, in a laundry handling apparatus according to an embodiment of the present invention.

As shown in FIG. 4A, the laundry time of the first laundry unit 140 is set such that the laundry setting is inputted at a first time T1 to start laundering and the laundering is finished at a third time T3. In addition, as shown in FIG. 4B, the second laundry unit 150 is set such that the laundry setting is inputted at the first time T1 to start laundering and the laundering is finished at a second time T3 before the third time T3.

The first controller 110 and the second controller 210 mutually transmit and receive data to check that the first and second laundry units perform the laundering simultaneously.

The first controller 110 compares the finish time according to the laundry time of the first laundry unit with the finish time of the second laundry unit to calculate a time difference TD1, and sets the simultaneous finish when the time difference is equal to or less than a first set time. The first controller 110 transmits data according to the simultaneous finish setting to the second laundry unit 150 through the first communication unit 180. Thereafter, the second controller 210 add the time difference TD1 to the laundry time of the second laundry unit (W2) so that the first and second laundry units are set to finish simultaneously.

Meanwhile, if the time difference TD1 between the finish time of the first laundry unit 140 and the finish time of the second laundry unit 150 exceeds the first set time, the first controller 110 sets the first laundry unit and the second laundry unit to operate individually.

At this time, when the simultaneous finish key is inputted from any one of the first input unit 144 and the second input unit 154, the first controller 110 or the second controller 21 sets the simultaneous finish so that the first laundry unit and the second laundry unit finish operation simultaneously regardless of the time difference of the laundry time.

The first controller 110 outputs a notification according to the simultaneous finish setting through the first output unit 142. In addition, the second controller 210 outputs a notification according to the change of the laundry time and the simultaneous finish through the second output unit 152.

Figure 5:
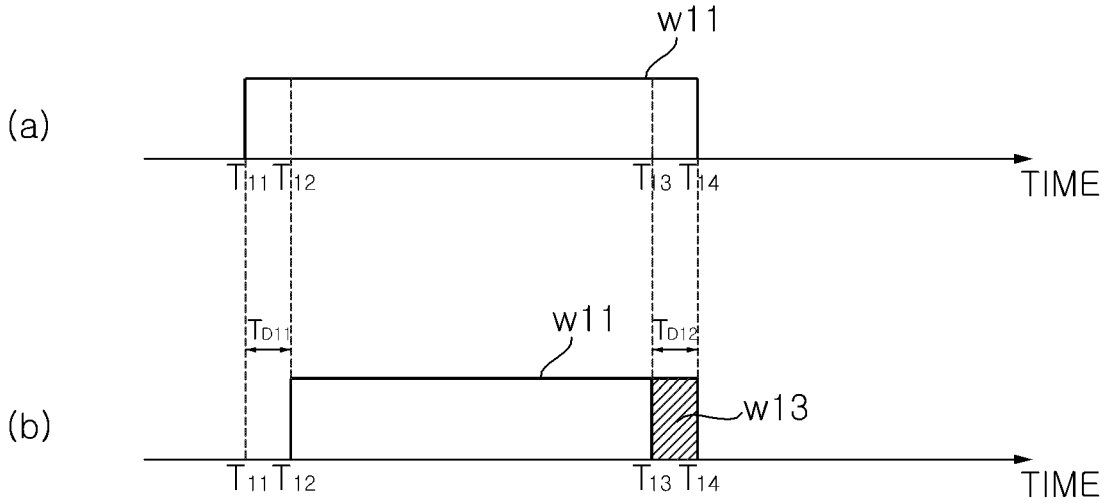
FIG. 5 and FIG. 6 are exemplary diagrams for explaining the change of laundry time according to the simultaneous finish of differently started operations, in a laundry handling apparatus according to the embodiment of the present invention.
Figure 6:
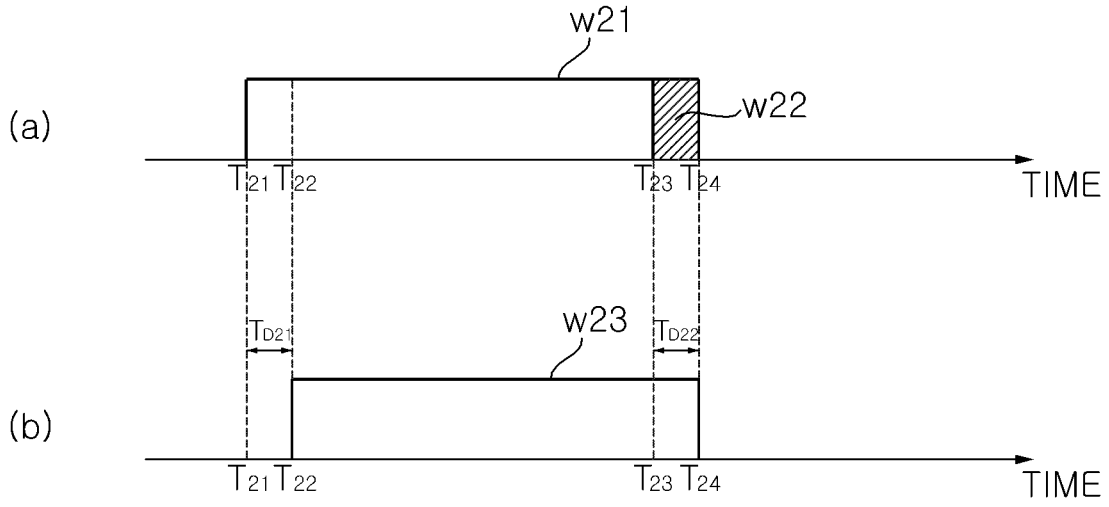

FIG. 5 and FIG. 6 are exemplary diagrams for explaining the change of laundry time according to the simultaneous finish of differently started operations, in a laundry handling apparatus according to the embodiment of the present invention.

When the first laundry unit 140 is set to start the laundering at a eleventh time T11 and finish the laundering at a fourteenth time T14 as shown in FIG. 5A, and when the second laundry unit 150 is set to start the laundering at a twelfth time T12 and finish the laundering at a thirteenth time T13 as shown in FIG. 5B, the first controller 110 and the second controller 210 calculate the time difference between the start time and the finish time respectively, and, thereafter, set whether to simultaneously finish the operation.

When the first laundry unit 140 starts the operation at the eleventh time T11 and the laundry setting is inputted to the second laundry unit 150 and starts the operation at the twelfth time T12, the first controller 110 checks that the first laundry unit and the second laundry unit operate simultaneously, based on the data of the laundry setting inputted from the second laundry unit during the operation.

The first controller 110 calculates a start time difference TD11 between the eleventh time T11 and the twelfth time T12. When the start time difference TD11 is equal to or less than a second set time, the first controller 110 sets the simultaneous finish, and transmits data on the simultaneous finish setting to the second laundry unit 150. At this time, since the second laundry unit 150 finishes the operation at the thirteenth time T13, the second controller 210 adds the laundry time according to a finish time difference TD12 so that the first laundry unit and the second laundry unit finish operation simultaneously.

In addition, as shown in FIGS. 6A and 6B, when the first laundry unit starts operation at a twenty-first time T21 and finishes the operation at a twenty-third time T23, and when the second laundry unit starts operation at a twenty-second time T22 and finishes the operation at a twenty-fourth time T24, the first laundry unit sets the simultaneous finish when a start time difference TD21 is equal to or less than a second set time. At this time, the first controller 110 changes the laundry time by adding a finish time difference TD22 to a preset laundry time that finishes at the twenty-third time T23 so that the first laundry unit and the second laundry unit finish operation simultaneously at the twenty-fourth time T24.

When simultaneous finish is set as described above, the first controller 110 and the second controller 210 output a simultaneous finish notification through the output units 142 and 152 respectively. When the laundry time is changed, the first controller 110 and the second controller 210 output a notifications in accordance with time change.

At this time, the first controller 110 and the second controller 210 can cancel the simultaneous finish setting, when the cancel key is inputted through the input units 144 and 154 respectively, when setting a simultaneous finish.

Meanwhile, in the above described FIG. 5 and FIG. 6, when the finish time difference TD12, TD22 is equal to or greater than a third set time, the first controller 110 and the second controller 210 may set the first and second laundry units to operate individually. The third set time may be the same as the first set time, but may be changed according to a total laundry time.

Figure 7:
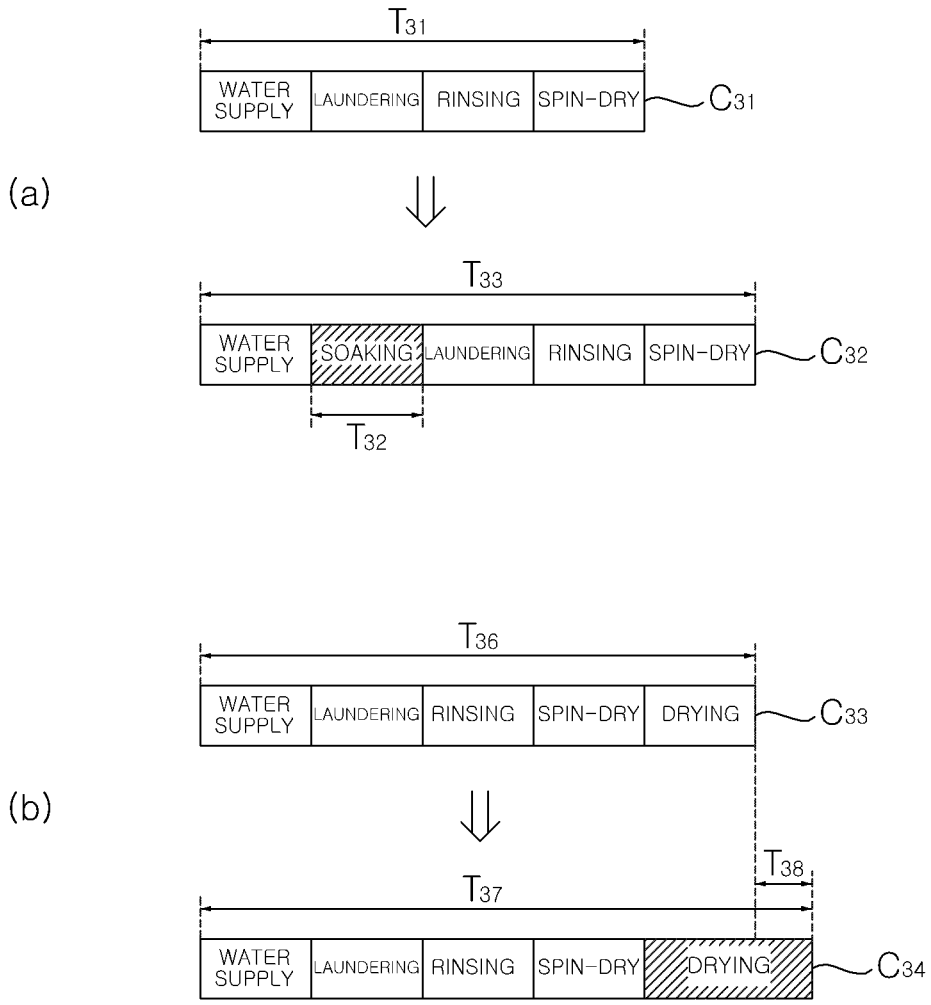
FIG. 7 is an exemplary diagram for explaining a change of operation according to the simultaneous finish setting of a laundry handling apparatus according to an embodiment of the present invention.

FIG. 7 is an exemplary diagram for explaining a change of operation according to the simultaneous finish setting of a laundry handling apparatus according to an embodiment of the present invention.

When the simultaneous finish is set as described above and the laundry time is changed, the operation according to the laundry setting can be changed or added, as shown in FIG. 7. Hereinafter, it is illustrated that the laundry time and operation are changed by the first laundry unit 140, but this can be identically applied to the second laundry unit 15.

As shown in FIG. 7A, the first controller 110 may change the laundry time from a thirty-first time T31 to a thirty-third time T33 as the simultaneous finish is set.

The first controller 110 implements an operation of water supply, laundering, rinsing, and spin-dry according to a laundry setting C31 of the first laundry unit 140 which is initially inputted before change, and a corresponding laundry time is calculated as the thirty-first time T31.

When the laundry time is changed as the simultaneous finish is set (C32), the first controller 110 adds a soaking process between the water supply and the laundering process to change the total laundry time from the thirty-first time T31 to the thirty-third time T33.

At this time, the first controller 110 may change the laundry time by adding a crease resistant process or a cooling process after the spin-dry process, in addition to the soaking process. In addition, the first controller 110 may add a waiting time between the laundering, rinsing, spin-dry, and drying processes, or may change the laundry time by delaying the start of any one of the processes.

In addition, as shown in FIG. 7B, when the simultaneous finish is set, in an initial laundry setting C33 formed of water supply, laundering, rinsing, spin-dry, and drying, the first controller 110 increases the time of the drying process to change the laundry setting (C34), so that the laundry time is changed from the from a thirty-sixth time T36 to a thirty-seventh time T37.

At this time, the first controller 110 may apply a control command to the first heater controller 170 to lower a set temperature of the first heater 171, or may decrease the number of the operating heaters to increase the drying time. In addition, the first controller 110 may change the laundry time by increasing or decreasing the time for the laundering process, the rinsing process, and the spin-dry process.

In addition, as the first laundry unit and the second laundry unit operate simultaneously, the first controller 110 delays any one of the operations so that the water supply, spin-dry, drying operations and the operation corresponding to the heating of the wash water are not simultaneously performed in the first and second laundry units, thereby allowing the first laundry unit and the second laundry unit to finish operation simultaneously.

Figure 8:
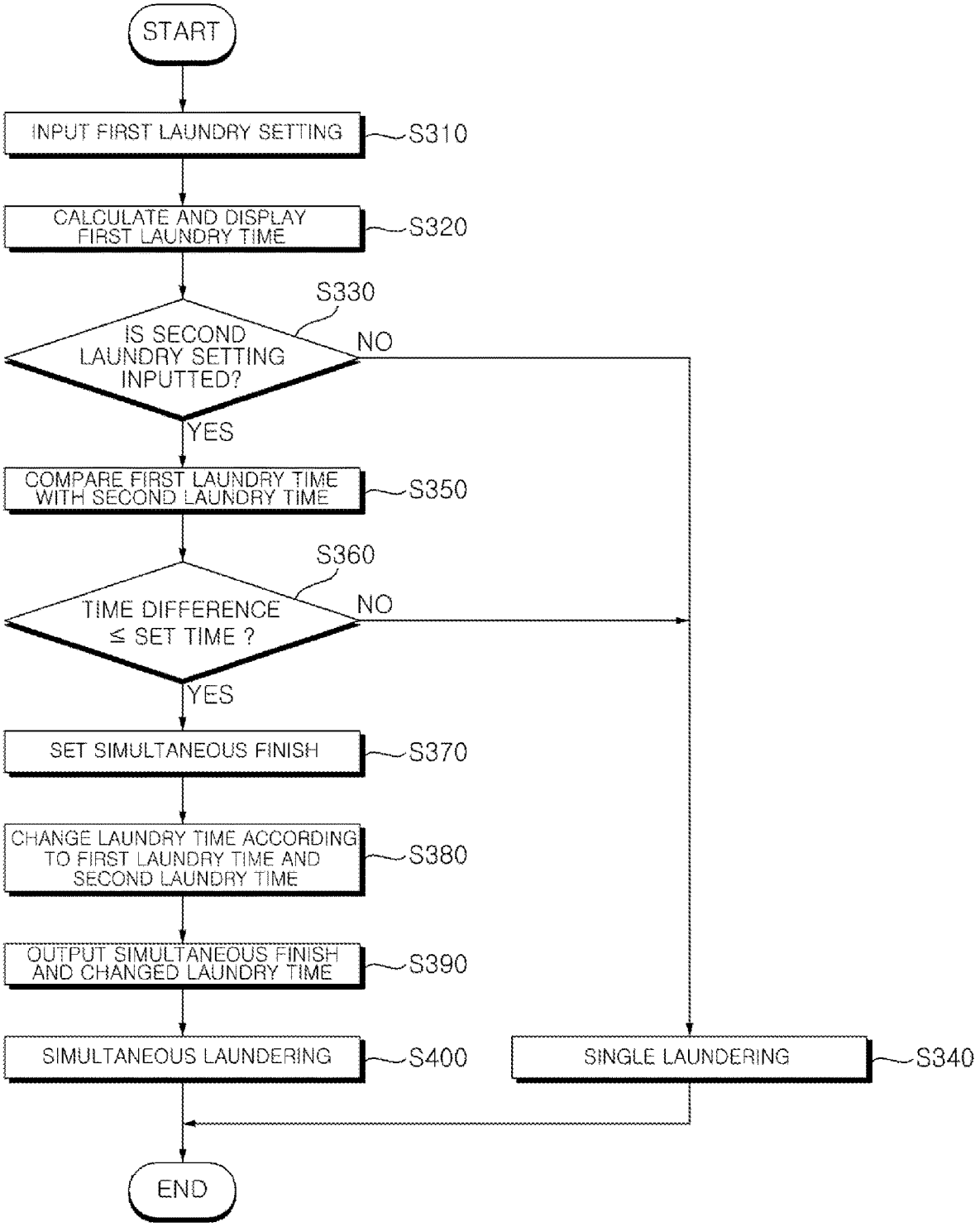
FIG. 8 is a flowchart illustrating a control method according to the simultaneous finish setting of a laundry handling apparatus according to an embodiment of the present invention.

FIG. 8 is a flowchart illustrating a control method according to the simultaneous finish setting of a laundry handling apparatus according to an embodiment of the present invention.

As shown in FIG. 8, when the laundry setting of the first laundry unit 140, i.e., a first laundry setting, is inputted through the first input unit 144 (S310), the first control unit 110 calculates a first laundry time of the first laundry unit 140 according to the first laundry setting, and displays the first laundry time on a display unit through the first output unit 142 (S320).

The first controller 110 transmits and receives data on the mutual laundry setting through the communication unit 180, 280 of the second controller 210.

When the second laundry setting is inputted to the second laundry unit 150 (S330), the first controller 110 determines that the first and second laundry units operate simultaneously, in response to the data received from the second laundry unit, and compares the first laundry time of the first laundry unit with the second laundry time of the second laundry unit (S350).

The first controller 110 calculates a time difference between the finish time of the first laundry time and the finish time of the second laundry time, and compares the time difference with a set time (S360).

In addition, the first controller 110 may compare the start time and finish time of the first laundry unit with the start time and finish time of the second laundry unit respectively, and set whether to finish the operation simultaneously. At this time, the start time is based on the time at which the laundry setting is inputted.

When the time difference between the finish time of the first laundry time and the finish time of the second laundry time is equal to or less than the set time, the first controller 110 sets a simultaneous finish so that the first laundry unit and the second laundry unit finish the operation simultaneously (S370). The set time is the first set time or the third set time described above.

Meanwhile, if there is no separate input from the second laundry unit, or if the time difference of the finish time exceeds the set time, the first laundry unit and the second laundry unit perform laundry individually (S340).

At this time, even if the time difference of the finish time exceeds the set time, the first controller 110 may set the simultaneous finish when a simultaneous finish key is inputted through the first input unit 144.

When the simultaneous finish is set, the first controller 110 changes any one laundry time according to the first laundry time of the first laundry unit and the second laundry time of the second laundry unit according to the setting of simultaneous finish (S380).

The first controller 110 transmits data on the simultaneous finish setting to the second laundry unit. At this time, when the first laundry time is changed, the first controller 110 transmits data on the simultaneous finish setting to the second laundry unit. When the second laundry time is changed, the first controller 110 transmits data on the simultaneous finish setting and the second laundry time change to the second laundry unit.

When the first laundry time is changed, the first controller 110 may increase or decrease the time for any one operation and add a waiting time so that the laundering operation is finished at a specific time according to the changed laundry time, or add a soaking process, a crease resistant process, a cooling process, and the like so that the first laundry unit and the second laundry unit can be finished simultaneously.

In addition, when the second laundry time is changed, the second controller 210 may add the laundering process or change the time, as described above, in response to the received data on the laundry time change, so that the first laundry unit and the second laundry unit can be finished simultaneously.

The first controller 110 outputs a notification in accordance with the simultaneous finish setting, and information on the changed laundry time through the first output unit 142 (S390).

At this time, the first controller 110 may display the simultaneous finish notification and the information on the change of the laundry time through a display unit, and, in some cases, may display a guide message for whether to progress continuously according to change of laundry time After the guide message for whether to progress is displayed, when a progress key is inputted through the first input unit 144 in response to the guide message, the operation proceeds according to the laundry time changed by the simultaneous finish setting. When a cancel key is inputted, the simultaneous finish setting is canceled and the first and second laundry units perform individual laundry according to each laundry setting.

When setting the simultaneous finish, the first and second laundry units perform laundry simultaneously, and finish the laundry simultaneously in response to the changed laundry time (S400).

When the laundry is finished, a notification of finish is outputted so that the user can collect the laundry.

Figure 9:
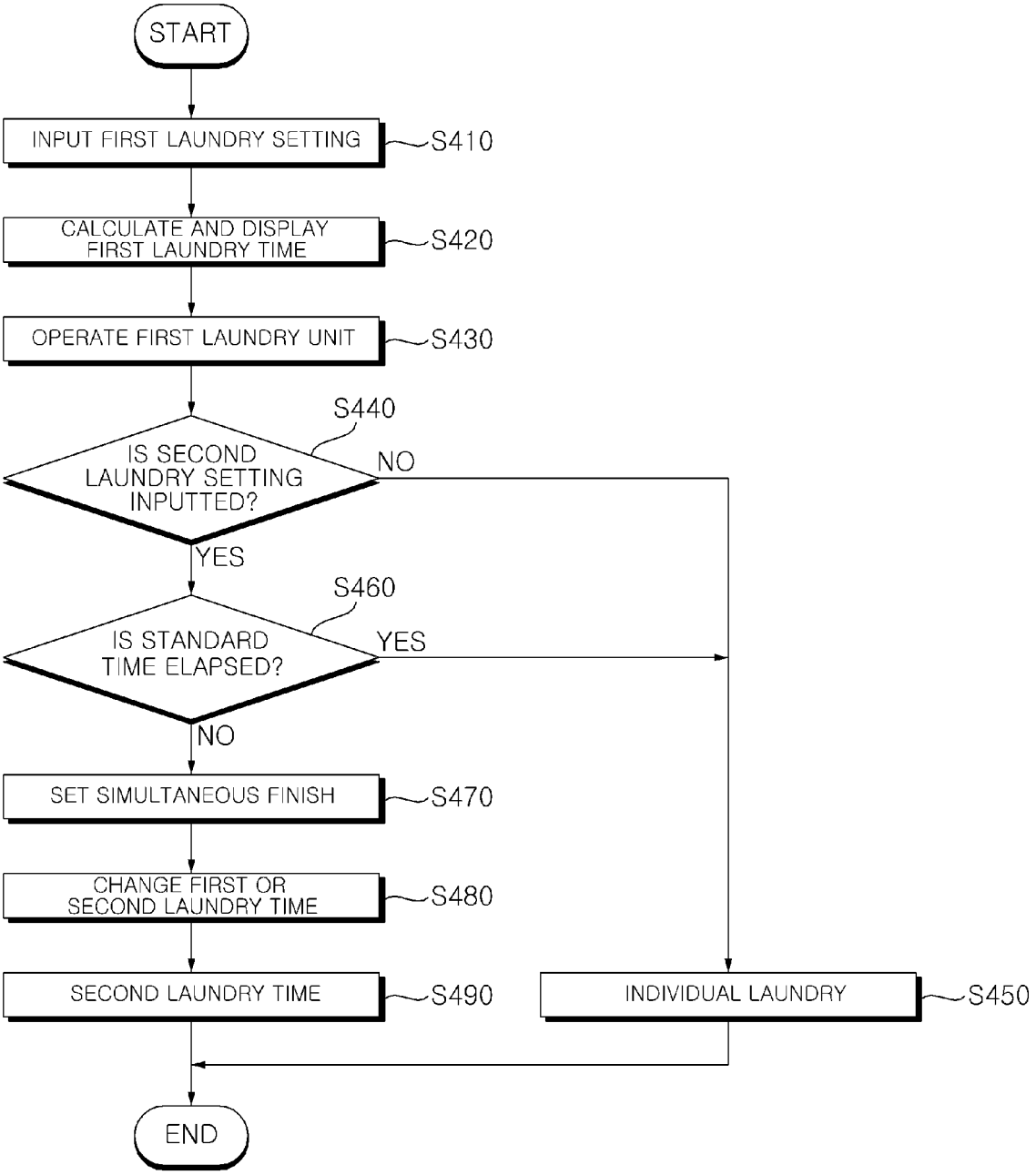
FIG. 9 is a flowchart showing a simultaneous finish setting method of a laundry handling apparatus according to an embodiment of the present invention.

FIG. 9 is a flowchart showing a simultaneous finish setting method of a laundry handling apparatus according to an embodiment of the present invention.

As shown in FIG. 9, when the laundry setting of the first laundry unit 140, i.e., the first laundry setting, is inputted through the first input unit 144 (S410), the first controller 110 calculates the first laundry time of the first laundry unit 140 according to the first laundry setting and displays the calculated first laundry time on the display unit through the first output unit 142 (S420).

The first controller 110 controls to apply a control command to the first motor driving unit 130 and the first heater controller 170 according to the inputted first laundry setting so that the laundry is performed.

Accordingly, the first laundry unit 140 operates to perform laundry (S430). At this time, the laundry includes all operations including laundering, rinsing, spin-dry, and drying.

When the second laundry setting is inputted to the second laundry unit 150 while the first laundry unit 140 performs operation according to the first laundry setting (S440), the first control unit 110 compares the inputted time of the laundry setting of the first laundry unit or the elapsed time after the first laundry unit starts laundry with the set time (S460). At this time, the above described second set time is applied to the set time.

The first controller 110 transmits and receives data on the mutual laundry setting through the communication unit 180, 280 of the second controller 210.

When the second laundry setting is not inputted to the second laundry unit 150 while the first laundry unit 140 is operating according to the first laundry setting, the simultaneous laundry condition is not satisfied so that the first laundry unit performs a single laundry.

In addition, even if the laundry setting is inputted by the second laundry unit while the first laundry unit 140 is operating, when the set time has elapsed after the operation of the first laundry unit, the first controller 110 does not set the simultaneous laundering, but the first laundry unit and the second laundry unit perform laundry individually according to each laundry setting (S450).

Meanwhile, when the laundry setting is inputted by the second laundry unit while the first laundry unit is operating, if the elapsed time, after the first laundry unit starts operation until the laundry setting of the second laundry unit is inputted, is equal to or less than the set time, the first controller 110 sets the simultaneous finish so that the first and second laundry units finish operation simultaneously (S470).

The first controller 110 compares the first laundry time with the second laundry time to change at least any one laundry time (S480).

When the first laundry time is changed, the first controller 110 may change the laundry time by adding a certain operation or changing the time of a preset operation. When the second laundry time is changed, the first controller 110 transmits data on the simultaneous finish setting and the laundry time change to the second laundry unit 150. Accordingly, the second controller 210 changes the second laundry time by adding an operation or changing an operation time.

When the laundry time is changed, the first controller 110 and the second controller 110 can change the laundry time so that operation such as water supply, spin-dry, drying, wash water heating, and the like which can cause the vibration or the increase of power consumption as the first laundry unit and the second laundry unit operate simultaneously is not performed simultaneously.

The first controller 110 outputs the notification in accordance with the simultaneous finish setting and information on the changed laundry time through the first output unit 142.

The first laundry unit and the second laundry unit perform laundry simultaneously, and finish the laundry simultaneously in response to the changed laundry time (S490).

When the laundry is finished, a notification of finish is outputted so that the user can collect the laundry. At this time, the operation of the first laundry unit and the second laundry unit are finished simultaneously, so that the user can collect the laundry of the first laundry unit and the second laundry unit at a time.

Therefore, according to the present invention, in the first laundry unit and the second laundry unit that independently perform laundry, when the first laundry unit and the second laundry unit operate simultaneously, the first laundry unit and the second laundry unit are set to finish operation simultaneously, so that the laundry of the first laundry unit and the laundry of the second laundry unit can be collected at a time and the laundry can be easily collected. In addition, when the laundry time is changed, damage to the laundry handling apparatus can be prevented and energy efficiency can be improved by changing the operations such as spin-dry, drying, wash water heating, and the like not to be performed simultaneously during the simultaneous operation.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A laundry handling apparatus comprising:

a first laundry unit having a first tub and configured to perform a first laundry operation;

a second laundry unit having a second tub and configured to perform a second laundry operation; and a first controller configured to control the first laundry unit, a second controller configured to control the second laundry unit, wherein, when the first laundry operation and the second laundry operation are simultaneously performed, the first controller compares a first laundry time for the first laundry operation with a second laundry time for the second laundry operation, performs the first laundry operation such that the first laundry operation and the second laundry operation are finished simultaneously when a time difference between the first laundry time and the second laundry time is equal to or less than a set time, and performs the first laundry operation without changing the first laundry time when the time difference between the first laundry time and the second laundry time exceeds the set time.

2. The laundry handling apparatus of claim 1, wherein the first controller activates a simultaneous finish in which the first laundry operation and the second laundry operation are finished simultaneously by adjusting an operation time for at least one of a laundering process, a rinsing process, a spin-dry process, or a drying process included in the first laundry operation.

3. The laundry handling apparatus of claim 2, wherein the first laundry operation includes the spin-dry process and drying process, and wherein the first controller activates the simultaneous finish by adjusting at least one of a spin-dry speed with respect to the spin-dry process in the first laundry operation or by varying at least one of a number of operating heaters or a temperature of at least one of the heaters with respect to the drying process in the first laundry operation.

4. The laundry handling apparatus of claim 1, wherein the first controller increases the first laundry time by controlling the first laundry unit to further perform at least one of a soaking process, a crease resistant process, or a cooling process, or shortens a time for the soaking process, the crease resistant process, and the cooling process included in the first laundry process to activate a simultaneous finish in which the first laundry operation and the second laundry operation are finished simultaneously.

5. The laundry handling apparatus of claim 1, wherein the first controller activates a simultaneous finish in which the first laundry operation and the second laundry operation are finished simultaneously by controlling the first laundry unit to have a waiting time between at least two of a laundering process, a rinsing process, a spin-dry process, or a drying process of the first laundry process.

6. The laundry handling apparatus of claim 1, wherein the first controller activates a simultaneous finish in which the first laundry operation and the second laundry operation are finished simultaneously by delaying at least one of water supply, spin-dry, drying, or wash water heating operations of the first laundry unit such that each of the water supply, spin-dry, drying, and wash water heating operations of the first laundry unit is not performed simultaneously with respective one of water supply, spin-dry, drying, and wash water heating operations of the second laundry unit.

7. The laundry handling apparatus of claim 1, wherein the first controller performs the first laundry operation such that the first laundry operation and the second laundry operation are finished simultaneously if the time difference between the first laundry time and the second laundry time is equal to or less than a set time, even if a simultaneous finish command to terminate the first laundry operation and the second laundry operation at a same time is not inputted through an input device.

8. The laundry handling apparatus of claim 1, further comprising an output device configured to display an operation state of the first laundry unit, wherein the output device outputs a guide message for a simultaneous finish in which the first laundry operation and the second laundry operation are finished simultaneously through a change of the first laundry time by a control of the first controller, when the simultaneous finish is activated.

9. The laundry handling apparatus of claim 8, further comprising an input device having a progress key and a cancel key, wherein the first controller activates the simultaneous finish when the progress key is inputted or when the cancel key is not inputted within a certain time, and deactivates the simultaneous finish when the cancel key is inputted.

10. The laundry handling apparatus of claim 1, further comprising an input device having a simultaneous finish key, wherein, when the simultaneous finish key is inputted, the first controller adjust the first laundry time to activate a simultaneous finish in which the first laundry operation and the second laundry operation are finished simultaneously even if the time difference exceeds the set time.

11. The laundry handling apparatus of claim 1, wherein the second laundry unit and the first laundry unit are disposed vertically.

12. The laundry handling apparatus of claim 1, wherein the first controller performs the first laundry operation such that the first laundry operation and the second laundry operation are finished simultaneously when a first time difference between finish times of the first or second laundry times is equal to or less than a first set time, and a second time difference between start times of the first or second laundry times is equal to or less than a second set time.

* * * * *